US005697387A

United States Patent [19]

Hanisco

[11] Patent Number: 5,697,387

[45] Date of Patent: Dec. 16, 1997

[54] INTERCHANGEABLE DECORATIVE ARTICLE

[76] Inventor: Christine Hanisco, 103 Elk Creek Rd., Oxford, Pa. 19363

[21] Appl. No.: 615,977

[22] Filed: Mar. 14, 1996

[51] Int. Cl.[6] ..... A45D 8/12

[52] U.S. Cl. ..... 132/275; 132/273; 132/276; 132/277; 132/278

[58] Field of Search ..... 132/273, 274, 132/275, 276, 277, 278, 279; 2/174

[56] References Cited

U.S. PATENT DOCUMENTS

| | | | |
|---|---|---|---|
| D. 315,036 | 2/1991 | Leopold . | |
| 1,652,462 | 12/1927 | Stephens . | |
| 3,211,160 | 10/1965 | Miller | 132/275 |
| 3,303,514 | 2/1967 | Wessels | 2/174 |
| 4,665,595 | 5/1987 | Viot et al. | 24/616 |
| 4,793,155 | 12/1988 | Law et al. | 63/2 |
| 4,912,944 | 4/1990 | Crosley et al. | 132/275 |
| 4,982,581 | 1/1991 | Furuyama | 63/29.1 |
| 5,195,336 | 3/1993 | Mershon . | |
| 5,265,278 | 11/1993 | Watanabe | 2/174 |
| 5,283,966 | 2/1994 | Rader | 40/1.5 |
| 5,379,782 | 1/1995 | Tabb | 132/273 |
| 5,398,705 | 3/1995 | Hiltbrand et al. | 132/273 |
| 5,410,764 | 5/1995 | Katz | 24/589 |
| 5,441,061 | 8/1995 | Jordan et al. | 132/275 |
| 5,456,274 | 10/1995 | Selbee et al. | 132/275 |

*Primary Examiner*—Gene Mancene
*Assistant Examiner*—Pedro Philogene

[57] ABSTRACT

The invention consists of a removable flexible material cover for an article of fashion such as, hair barrettes, jewelry, and belt buckles. The cover comprises one or more pieces of said flexible material, with at least one piece of material being a shape similar to the shape of the article to be covered. An elasticized band is sewn or otherwise held along the perimeter of the material piece or pieces. The elasticized band acts to pull the material taut over the fashion accessory base, and thus assists in holding the cover in place. Decorative embellishments may be attached to the cover if desired, for further aesthetic appeal so that different decorations, at the discretion of the wearer, may be removably employed.

5 Claims, 6 Drawing Sheets

INTERCHANGEABLE DECORATIVE ARTICLE

TECHNICAL FIELD OF THE INVENTION

This invention relates in general to the field of decorative articles, and more particularly to interchangeable decorative articles.

BACKGROUND OF THE INVENTION

There exists many fashion accessory articles in the prior art. It is often desirable that these articles be decorated or otherwise ornamented for aesthetic appeal.

Applicant is aware of five prior art fashion accessory items having differing forms of decorative ornamentation. U.S. Pat. No. 1,652,462 issued Dec. 13, 1927 to Stephens for a Hair Dressing Article. U.S. Pat. No. 3,211,160 issued Oct. 12, 1965 to Miller for a Hair Band with Detachable Cover. French Pat. No. 1,217,287 issued to Pochet on May 3, 1960 for what the Applicant believes to be a Hair Band and Decorative Cover. U.S. Pat. No. 5,456,274 to Selbee and Kutzner for a Hair Band with Removable Cover, and U.S. Pat. No. 5,441,061 to unknown for Interchangeable Decorative Ornament and Method.

Stephens teaches a wire form hair band having ornamentation formed of a fabric envelope. The fabric envelope is held in place by the width spacing of the wire form and the length of the wire form so as to tighten the envelope on the form. Also disclosed is the use of a flexible band instead of a wire form inside the casing or cover. Stephens does not teach nor suggest making the fabric envelope removable, in that manner to enable changing the ornamentation on the hair band, by the manufacturer or user.

Miller teaches a flexible hair band having a detachable cover secured by releaseable fasteners. What is disclosed is an ornamental cover which wraps around the upper surface of the hair band at either end of the hair band and at the apex of the hair band. The hair band is of the conventional horse shoe shape type. In particular, Miller relies on snap fasteners or boot-like or equivalent at the ends of the ornamental strips to hold the ornamental strips in place over the upper surface of the horse shoe shaped hair band.

The Poget teaching illustrates the use of a Velcro™ strip or a strip of like hook and loop releaseable fasteners to releaseably attach decorative ornamentation to the surface of a horse shoe shaped hair band.

Selbee and Kutzner teach a flexible horse shoe shaped hair band with a cover comprised of an open-ended tubular sleeve of material having a longitudinal elasticized seam. The seam causes the tubular sleeve of material to gather and thus conform to the shape of the horse shoe shaped hair band. The effect is a ruffled or gathered appearance. The cover also has two more elasticized bands at the end of the tubular sleeve, as well as releaseable fasteners.

U.S. Pat. No. 5,441,061 teaches an ornament used for holding and displaying fabric items such as a scarf; comprised of a spring mechanism and fashion accessory. The fabric is pulled through the spring loops for display.

Applicant is also aware of U.S. Pat. No. Des. 315,036 which issued Feb. 26, 1991 to Leopold for a hair band. The hair band consists of a toroidal shaped tube of fabric and containing within the tube, a circle of elastic which acts to draw the tube together at the center so as to act as a hair elastic for holding a ponytail or like hair configuration. The circle of elastic is free floating within the tube.

SUMMARY OF THE INVENTION

With respect to prior art for incorporating fashion accessories, the prior art devices have considered different means for holding decorative ornamentation.

The applicant's device consists of a removable cloth material cover, and a fashion accessory such as, by way of example, hair barrettes, jewelry, and belt buckles. The cover is comprised of one or more pieces of material, with at least one piece of said material cut into a shape similar to the shape of the fashion accessory to be covered, with a tension means such as, an elasticized band, attached or otherwise held along the perimeter of the material piece or pieces. The elasticized band acts to pull the material taut over the fashion accessory base, and thus assists in holding the cover in place. Decorative embellishments may be attached to the cover if desired, for further aesthetic appeal.

A technical advantage of the present invention is that it provides an easy to use method for displaying decorative elements, such as printed fabrics and/or decorative embellishments.

Another technical advantage of the present invention is that it provides a means for interchanging decorative elements. The appearance of the fashion accessory may be quickly and easily changed by the user, by removing the cover and replacing with another cover. In this manner, a single decorative article may be used to compliment many different outfits. Furthermore, the decorative article, as displayed, does not appear to be interchangeable.

Another technical advantage of the present invention is that a single fashion accessory item, is employed to compliment many different styles of clothing as well as the user's personality, thus making the present invention much more cost effective than buying several fashion accessories, to fill the user's needs.

Another technical advantage of the present invention is it's excellent ability to hold heavier weight materials in place such as suede, leather and fur.

DETAILED DESCRIPTION OF THE PREFERRED EMBODIMENTS

Figure 1:
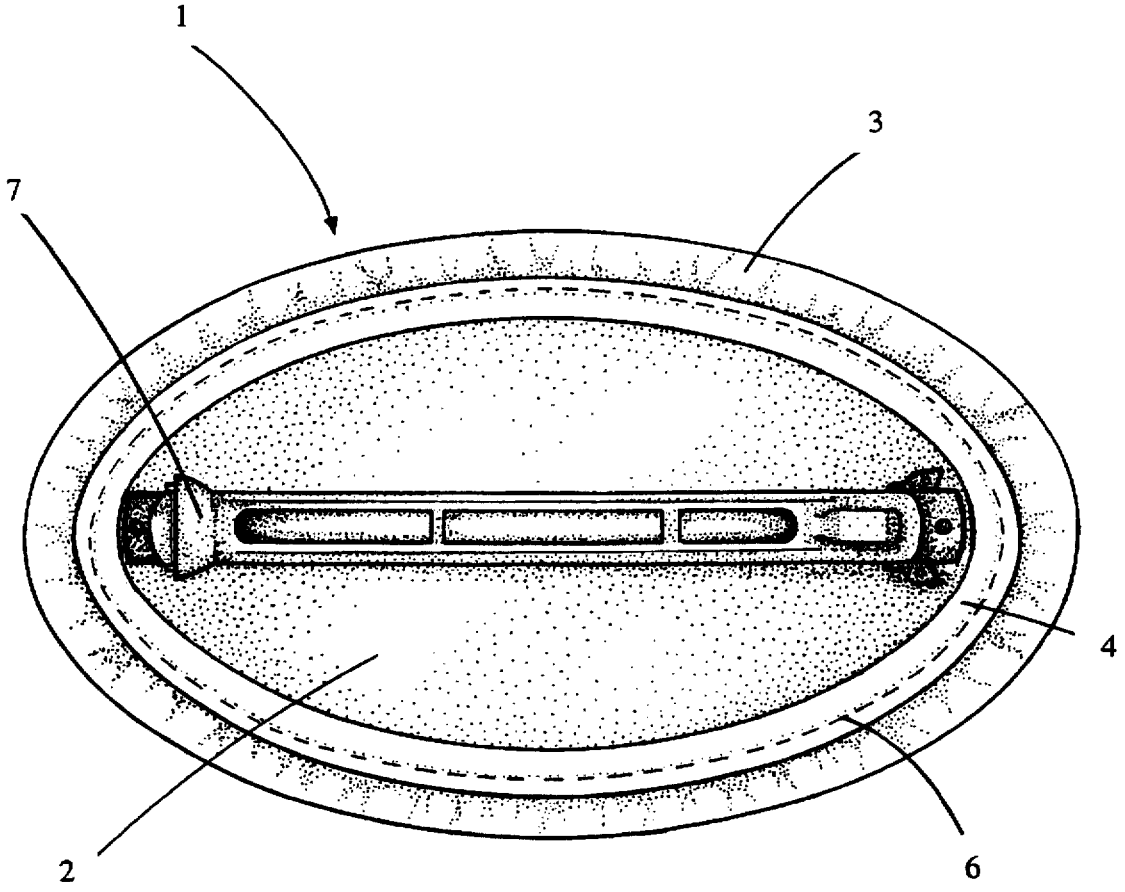
FIG. 1 is a bottom perspective view of the present invention, showing an embodiment of a decorative article constructed according to the teachings of the present invention.
Figure 2:
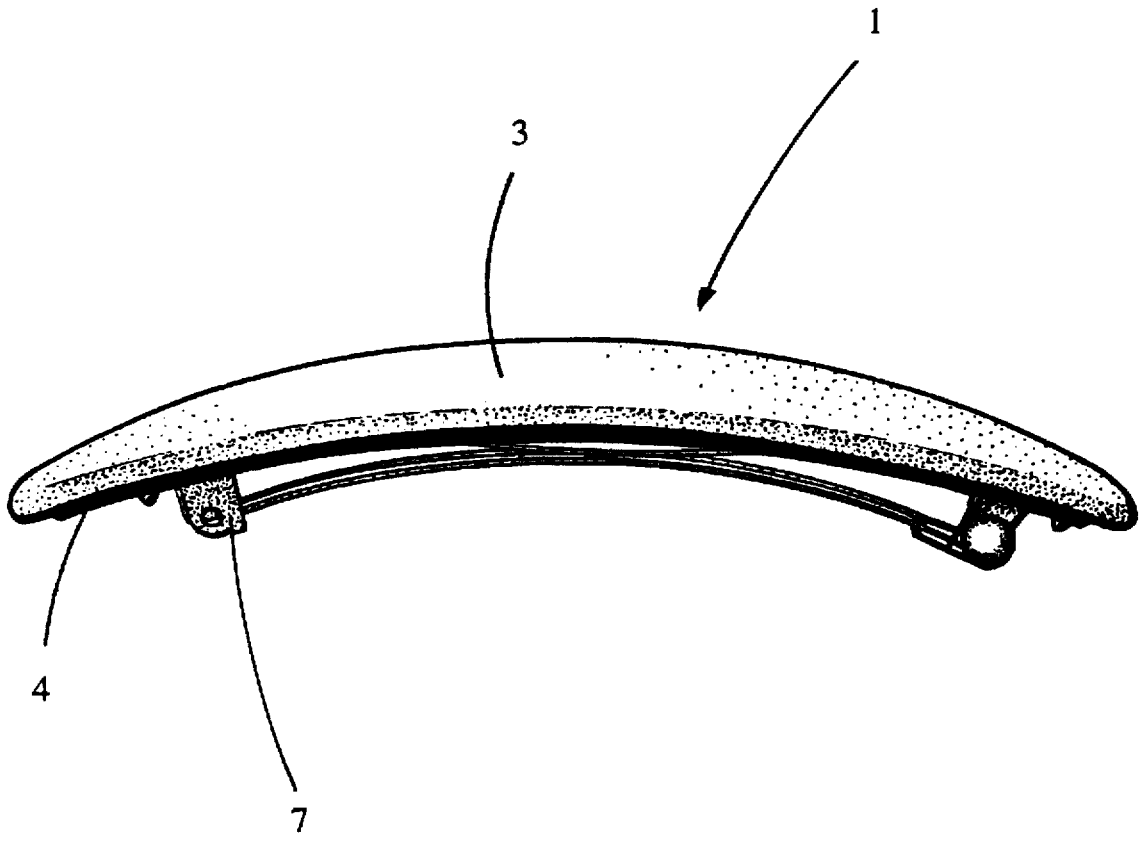
FIG. 2 is a side perspective view of the present invention, showing an embodiment of a decorative article constructed according to the teachings of the present invention.

FIG. 1 and FIG. 2 show bottom and side views of a fashion accessory depicted generally as a clipped 7 barrette. A barrette base 2, with a covering material 3 similar in shape to the barrette base, includes an elasticized band 4 sewn thereon at 6 around the perimeter of said material. This aids the material to deform into a shape which conforms naturally to the base of barrette.

Figure 3:
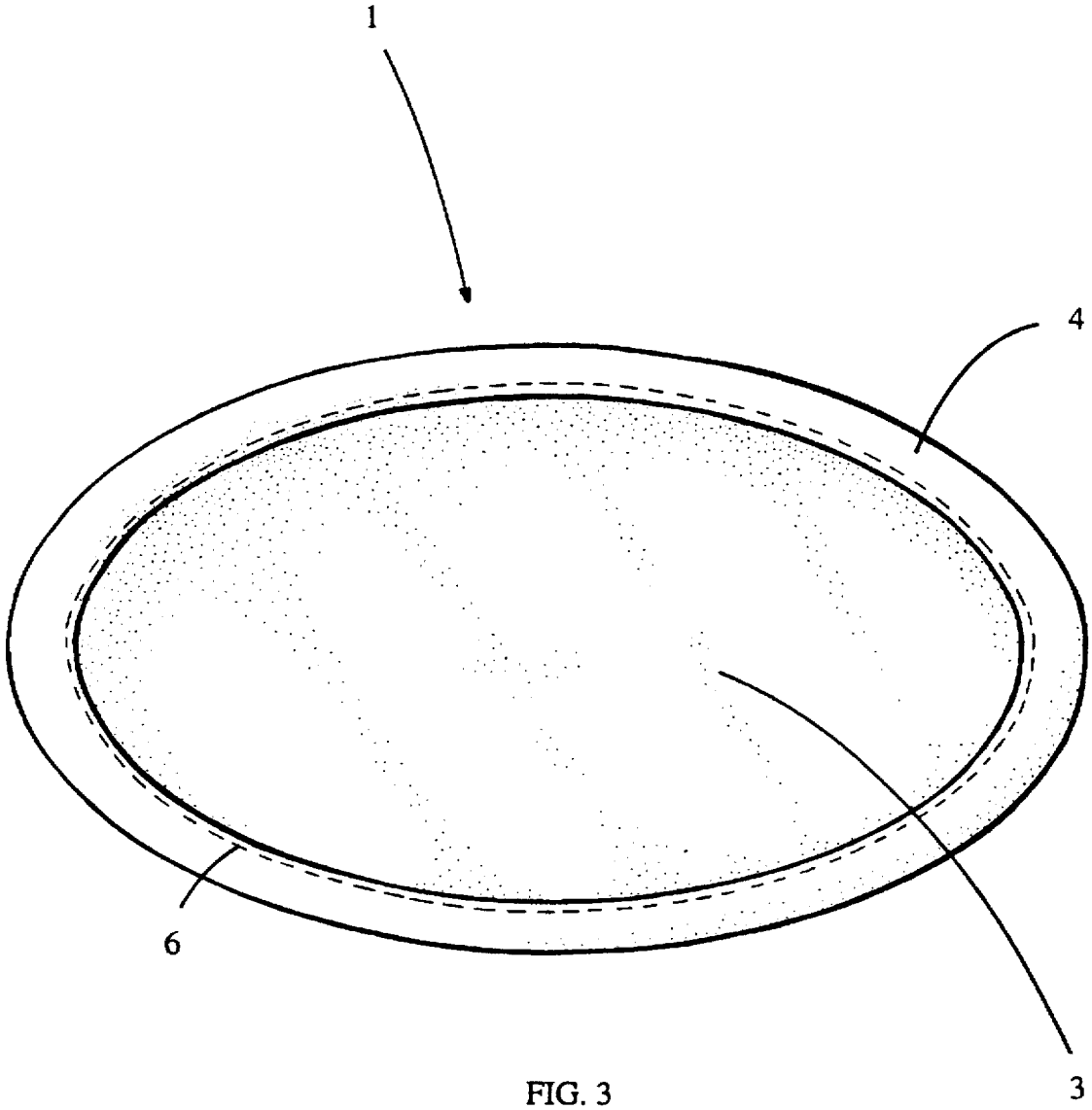
FIG. 3 is a plan view of the material and elasticized band, laid flat, of the cover.
Figure 4:
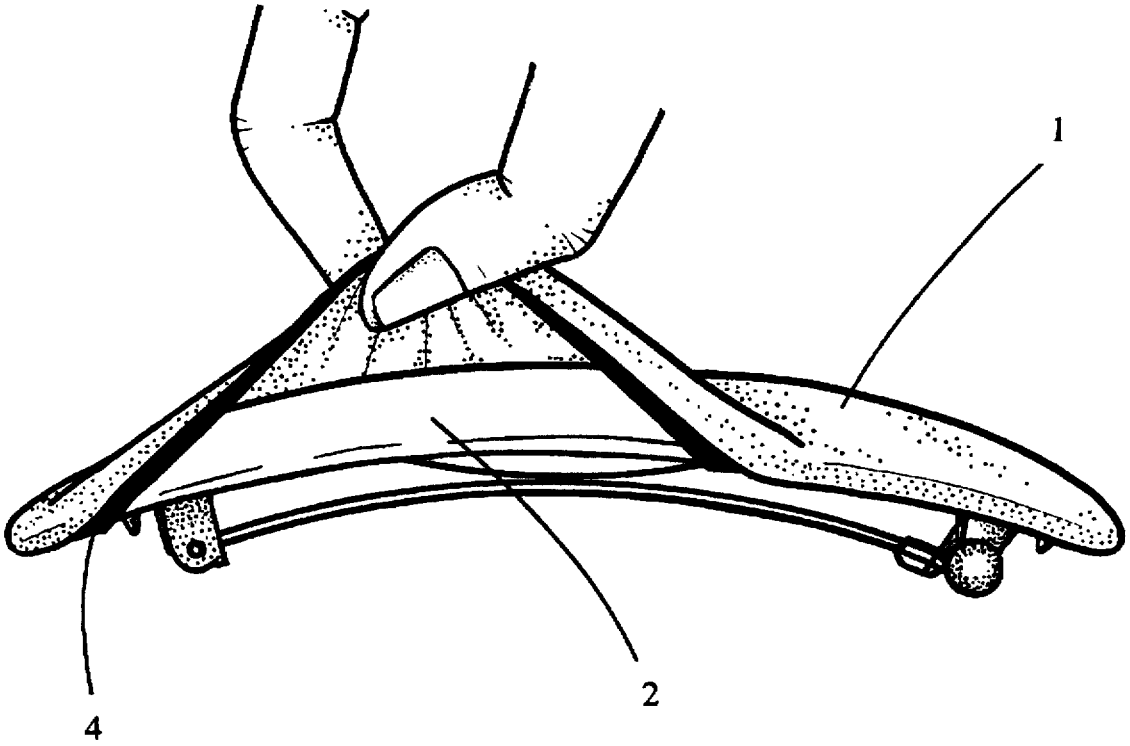
FIG. 4 illustrates the method for applying the cover to a fashion accessory item.

With reference to FIGS. 3 and 4 in manufacturing the interchangeable cover of the present invention, the following steps have been found advantageous:

1. Choose one or more aesthetically pleasing types of material 3.

2. Cut the material so as to follow the same shape as the fashion accessory base 2 the cover 1 will be used on, allowing enough extra material around the perimeter, to permit the material to follow the contour of the fashion accessory base as shown in FIG. 4, and be held in place by an elasticized band 4 under said base.

3. Measure and cut enough of the elasticized band to fit completely around the perimeter of the material.

4. The manufacturer may choose to hem the edges around the perimeter of the material at this time.

5. Attach the elasticized band along the entire perimeter of the side of the material to be displayed, while stretching the elasticized band and holding flat, thus forming a seam.

6. Remove any excess elasticized band or material by cutting.

7. Decorative embellishments 5 (FIG. 6) may be attached during any of the preceding steps, to increase aesthetic appeal.

8. With particular reference to FIG. 4, place cover over one end of fashion accessory base. Stretch tension seam, shown attached at 6 (FIG. 3), toward the opposite end of fashion accessory so that the cover tightly conforms to the shape of the fashion accessory base.

Figure 5:
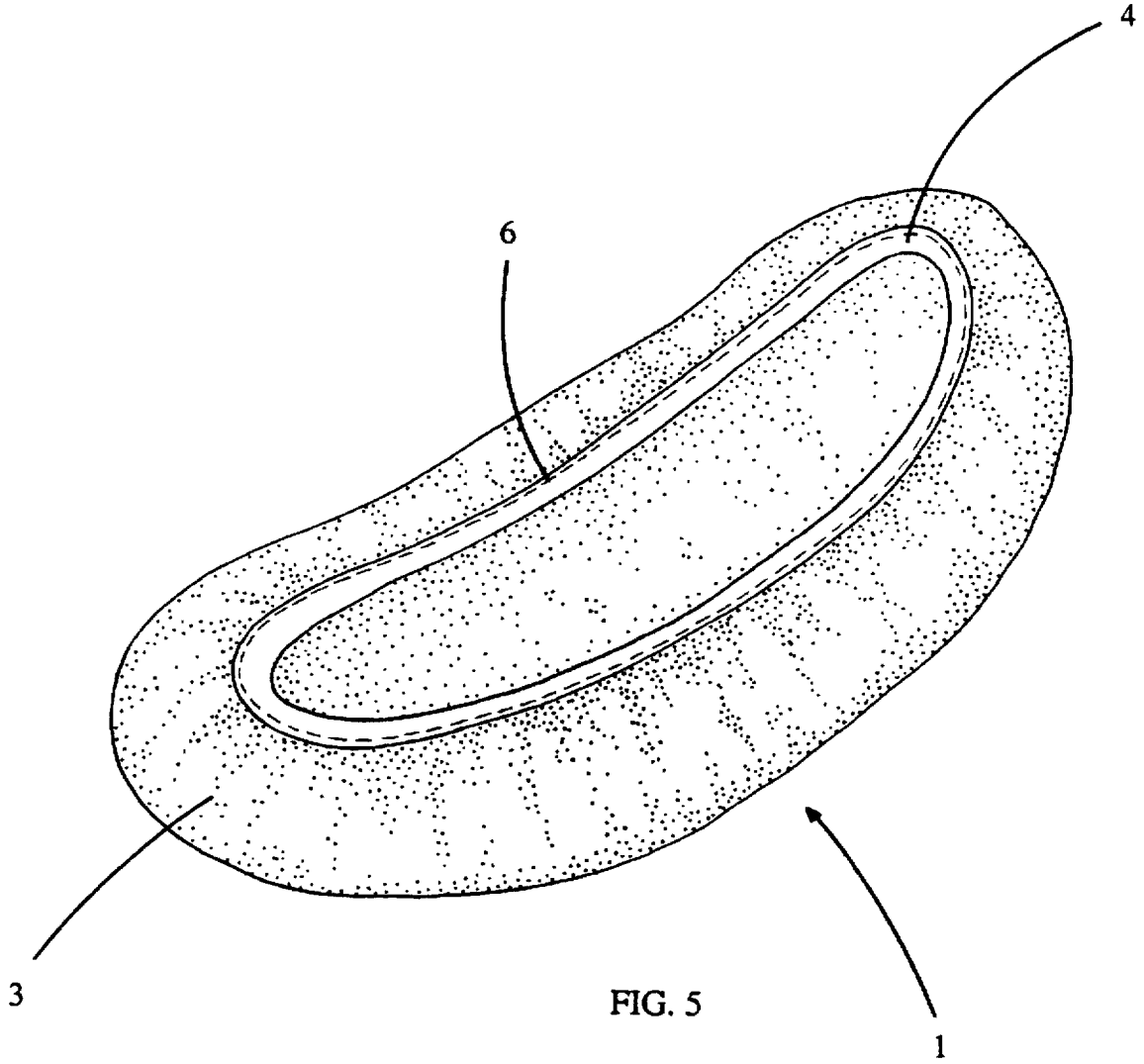
FIG. 5 is a perspective view of the cover of the present invention.

FIG. 5 shows the underside of cover 1 which can comprise one or more pieces of material 3. Note that elasticized band 4 is sewn at 6 around the perimeter of material.

Figure 6:
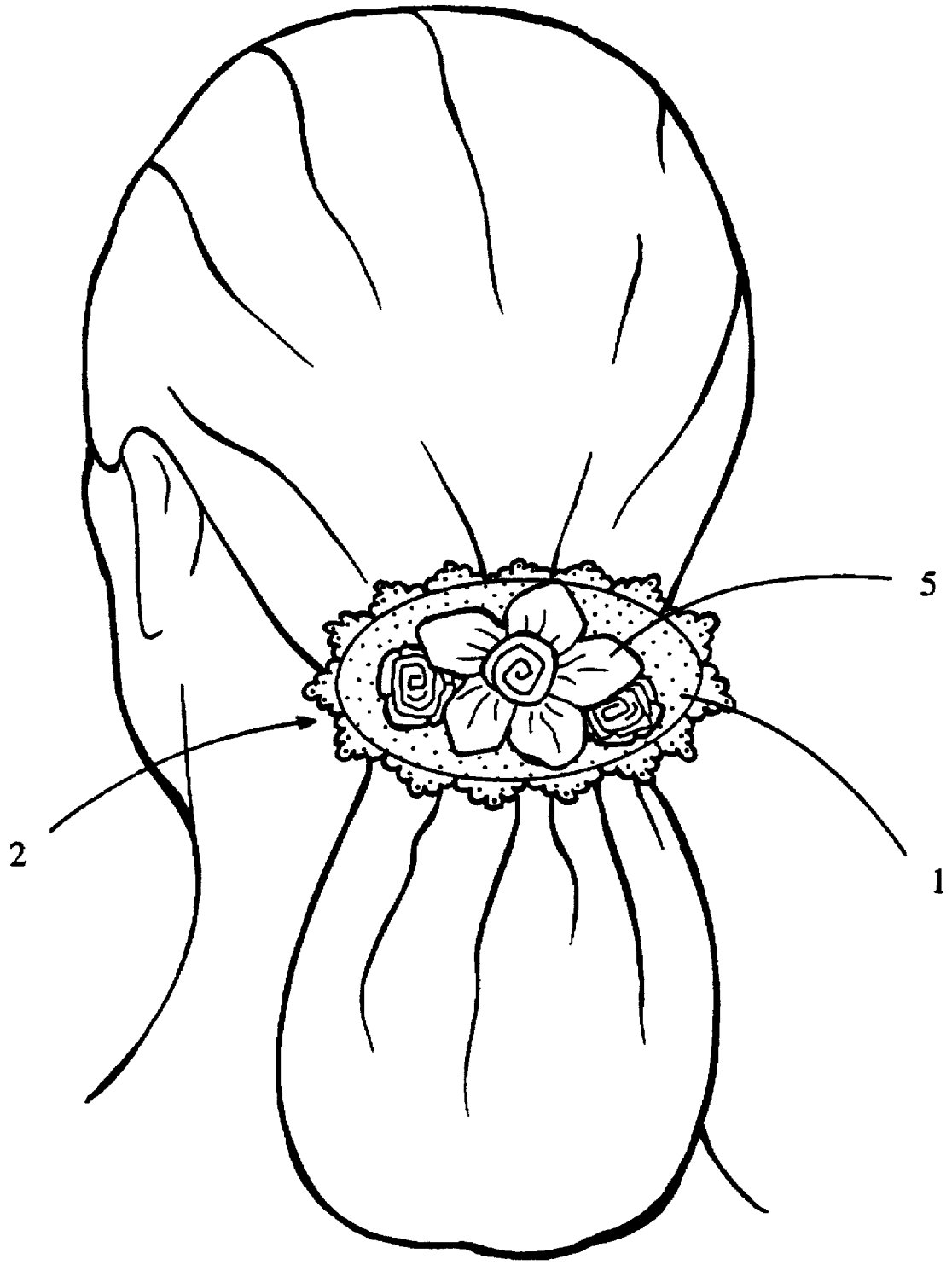
FIG. 6 illustrates a method of use of the present invention.

FIG. 6 depicts a fashion accessory barrette with cover. Note that the material includes decorative embellishments 5.

As will be apparent to those skilled in the art in the light of the foregoing disclosure, many alterations and modifications are possible in the practice of this invention without departing from the spirit and scope thereof. For example, the elastcized band may be encased by the material, or otherwise held free-floating, around the perimeter of the material rather than attached; lace and other embellishments may be attached around the perimeter between the material and elastcized band; the material can have a lace overlay; multiple tension means may be employed; the tension means could be a draw string; etc. Accordingly, the scope of the invention is to be construed in accordance with the substance defined by the following claims and their legal equivalents.

I claim:

1. An interchangeable decorative article of fashion worn by a person comprising a base of rigid inflexible material having a predetermined shape, attaching means positioned on said base for attaching to said person, a removable flexible cover disposed on said base with the perimeter thereof having the same general shape as said predetermined shape of said base, and at least one elasticized band combined with said perimeter so that together said cover and said elasticized band combination is larger in size than said base, whereby said removable cover and elasticized band combination enwraps said base to a back thereof to provide a pleasing to the eye view and to form a snug fit thereon, and, wherein said removable cover is interchangeable with other such cover and elasticized band combinations.

2. The article of fashion of claim 1 wherein said cover comprises; at least one piece of a flexible material of fashion.

3. The article of fashion of claim 1 wherein said attaching means is a hinged means and clasp in combination.

4. The article of fashion of claim 3 wherein said hinged means and clasp combination with said base forms a barrette.

5. The article of claim 2 wherein said flexible material cover further comprises, embellishments attached thereon whereby said article of fashion may be complementary to many different dress designs, styles and colors of the wearer.

* * * * *